US007126549B2

(12) United States Patent
Li et al.

(10) Patent No.: US 7,126,549 B2
(45) Date of Patent: Oct. 24, 2006

(54) SLOT COUPLING PATCH ANTENNA

(75) Inventors: Qian Li, Ann Arbor, MI (US); Wladimiro Villarroel, Worthington, OH (US)

(73) Assignee: AGC Automotive Americas R&D, Inc., Yipsilanti, MI (US)

( * ) Notice: Subject to any disclaimer, the term of this patent is extended or adjusted under 35 U.S.C. 154(b) by 0 days.

(21) Appl. No.: 11/025,499

(22) Filed: Dec. 29, 2004

(65) Prior Publication Data

US 2006/0139223 A1 Jun. 29, 2006

(51) Int. Cl.
*H01Q 1/32* (2006.01)

(52) U.S. Cl. ..... 343/713; 343/767; 343/770

(58) Field of Classification Search ..... 343/767, 343/770, 713, 704, 711
See application file for complete search history.

(56) References Cited

U.S. PATENT DOCUMENTS

| | | | | |
|---|---|---|---|---|
| 4,761,654 | A | 8/1988 | Zaghloul | |
| 4,903,033 | A | 2/1990 | Tsao et al. | |
| 4,916,457 | A | 4/1990 | Foy et al. | |
| 5,241,321 | A | 8/1993 | Tsao | |
| 5,448,250 | A | 9/1995 | Day | |
| 5,539,420 | A | 7/1996 | Dusseux et al. | |
| 5,633,645 | A | 5/1997 | Day | |
| 5,880,694 | A | 3/1999 | Wang et al. | |
| 6,018,319 | A | 1/2000 | Lindmark | |
| 6,028,561 | A | 2/2000 | Takei | |
| 6,054,953 | A | 4/2000 | Lindmark | |
| 6,075,490 | A * | 6/2000 | Sakaguchi et al. | 343/704 |
| 6,097,345 | A | 8/2000 | Walton | |
| 6,188,368 | B1 | 2/2001 | Koriyama et al. | |
| 6,304,226 | B1 | 10/2001 | Brown et al. | |
| 6,329,950 | B1 | 12/2001 | Harrell et al. | |
| 6,339,406 | B1 | 1/2002 | Nesic et al. | |
| 6,346,919 | B1 | 2/2002 | Wang et al. | |
| 6,359,593 | B1 | 3/2002 | Marino et al. | |
| 6,407,704 | B1 | 6/2002 | Franey et al. | |
| 6,452,552 | B1 | 9/2002 | Ishitobi et al. | |
| 6,506,487 | B1 | 1/2003 | Nagai | |
| 6,507,320 | B1 | 1/2003 | Von Stein et al. | |
| 6,518,930 | B1 | 2/2003 | Itoh et al. | |
| 6,620,477 | B1 | 9/2003 | Nagai | |
| 6,646,618 | B1 * | 11/2003 | Sievenpiper | 343/770 |
| 6,656,597 | B1 | 12/2003 | Takahara | |
| 6,733,872 | B1 | 5/2004 | Nagai | |
| 6,778,144 | B1 | 8/2004 | Anderson | |
| 2001/0015703 | A1 | 8/2001 | Nieminen | |
| 2003/0061765 | A1 | 4/2003 | Kawata et al. | |
| 2003/0076259 | A1 | 4/2003 | Zhang | |

* cited by examiner

*Primary Examiner*—Tho Phan
(74) *Attorney, Agent, or Firm*—Howard & Howard Attorneys, P.C.

(57) ABSTRACT

An antenna for receiving and/or transmitting circularly and/or linearly polarized RF signals includes a radiation element, a ground plane, a dielectric substrate, and a feed line. The radiation element is disposed on a pane of glass. The radiation element defines a slot having a first leg and a second leg forming the shape of a cross for generating the circular and/or linear polarization. The cross-shaped slot includes a center point. The ground plane is disposed substantially parallel to and spaced from the radiation element. The dielectric substrate is sandwiched between the radiation element and the ground plane. The feed line extends within the dielectric substrate and is electromagnetically coupled with the radiation element and the ground plane. The feed line terminates at a distal end short of the center point of the slot. That is, the feed line does not cross the center point. The antenna is compact in size and generally conformal to the pane of glass.

52 Claims, 9 Drawing Sheets

SLOT COUPLING PATCH ANTENNA

BACKGROUND OF THE INVENTION

1. Field of the Invention

The subject invention relates to an antenna, specifically a planar slot coupling patch antenna, for receiving a circularly polarized radio frequency (RF) signal from a satellite.

2. Description of the Prior Art

Vehicles have long implemented glass to enclose a cabin of the vehicle while still allowing visibility for the driver of the vehicle. Automotive glass is typically either a tempered (or toughened) glass or a laminated glass which is produced by bonding two or more panes of glass together with a plastic interlayer. The interlayer keeps the panes of glass together even when the glass is broken.

Recently, antennas have been integrated with the glass of the vehicle. This integration helps improve the aerodynamic performance of the vehicle as well to help present the vehicle with an aesthetically-pleasing, streamlined appearance. Integration of antennas for receiving linearly polarized RF signals, such as those generated by AM/FM terrestrial broadcast stations, has been the principal focus of the industry. However, that focus is shifting to integrating antennas for receiving RF signals from Satellite Digital Audio Radio Service (SDARS) providers. SDARS providers use satellites to broadcast RF signals, particularly circularly polarized RF signals, back to Earth. SDARS providers use multiple satellites in a geostationary orbit or in an inclined elliptical constellation.

Various antennas for receiving circularly polarized RF signals are well known in the art. Examples of such antennas are disclosed in the U.S. Pat. No. 5,633,645 (the '645 patent) to Day and U.S. Pat. No. 6,778,144 (the '144 patent) to Anderson.

The '645 patent discloses an antenna including a radiation element disposed on a pane of glass. The pane of glass is suitable for application as a window of a vehicle. A ground plane is disposed substantially parallel to and spaced from the radiation element. The ground plane defines a slot having a first leg and a second leg generally perpendicular to each other and forming a cross shape. The radiation element and the ground plane sandwich a dielectric layer. A feed line is disposed on a circuit board attached to the ground plane, such that the feed line is isolated from the ground plane. The feed line traverses a center point of the slot. The antenna of the '645 patent occupies a relatively large area on the pane of glass, which obstructs the view of a driver of the vehicle.

The '144 patent discloses an antenna including a radiation element. The radiation element defines a slot including a first leg and a second leg generally perpendicular to each other and forming a cross shape. The first and second legs are of unequal lengths and/or widths to give the antenna a circular polarization. A ground plane is disposed substantially parallel to and spaced from the first conductive layer. The radiation element and the ground plane sandwich at least one dielectric layer. A plurality of vias electrically connect the first conductive layer to the second conductive layer. A feed line is disposed within the at least one dielectric layer and is substantially parallel to the conductive layers. The feed line is disposed at a 45° angle in relation to the legs of the slot and traverses a center of the cross shape. The antenna of the '144 patent is not integrated with a window of a vehicle.

The characteristics of glass, particularly soda-lime-silica automotive glass, and the angled disposition of this glass when applied as a window of a vehicle, provide challenges to the effective integration of an antenna with a window of the vehicle. Automotive manufacturers demand strict requirements as to the amount of visual obstruction caused by antennas integrated with windows of the vehicle. To date, the performance of antennas integrated with automotive glass in receiving SDARS signals has been disappointing. Therefore, there remains an opportunity to introduce an antenna that aids in the reception of the circularly polarized RF signal from a satellite. Particularly, there remains an opportunity for a high-performing antenna that, when integrated with an automotive window does not create a substantial visual obstruction and still maintains optimal reception.

SUMMARY OF THE INVENTION AND ADVANTAGES

The subject invention provides an antenna including a radiation element. The radiation element defines a slot having a first leg and a second leg generally perpendicular with each other. The first and second legs of the slot form a periphery in the shape of a cross having a center point. A ground plane is disposed substantially parallel to and spaced from the radiation element. A dielectric is sandwiched between the radiation element and the ground plane and presents an edge. An electrically conductive feed line, having a distal end, extends within the dielectric from the edge of the dielectric. The feed line terminates at the distal end short of the center point of the slot.

The structure of the antenna of the subject invention provides excellent performance characteristics when receiving a circularly polarized RF signal. These characteristics include high radiation gain, a low axial ratio, and high radiation efficiency. The antenna of the subject invention may be integrated with a window of a vehicle. As a result, the antenna is generally conformal with the window and is relatively compact, occupying a relatively small area of the window, yet still providing a high performance when receiving the circularly polarized RF signal. Therefore, the antenna is desirable for automotive manufacturers and a driver of the vehicle.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Referring to the Figures, wherein like numerals indicate like parts throughout the several views, an antenna is shown generally at 10. In the preferred embodiment, the antenna 10 is utilized to receive a circularly polarized radio frequency (RF) signal from a satellite. Those skilled in the art realize that the antenna 10 may also be used to transmit the circularly polarized RF signal. Specifically, the preferred embodiment of the antenna 10 receives a left-hand circularly polarized (LHCP) RF signal like those produced by a Satellite Digital Audio Radio Service (SDARS) provider, such as XM® Satellite Radio or SIRIUS® Satellite Radio. However, it is to be understood that the antenna 10 may also receive a right-hand circularly polarized (RHCP) RF signal. Furthermore, the antenna 10 may also be utilized to transmit or receive a linear polarized RF signal.

Figure 1:
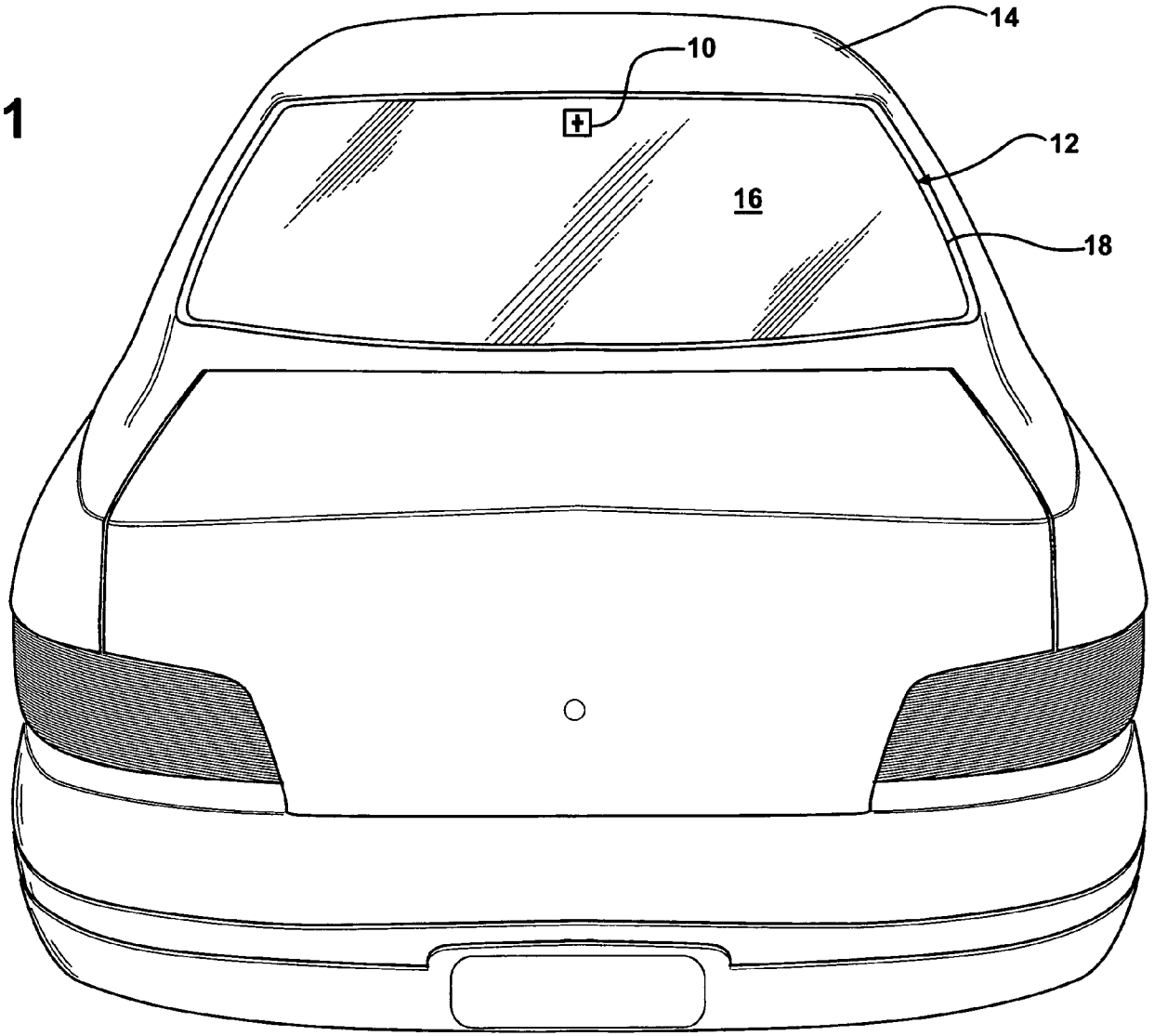
FIG. 1 is a perspective view of a vehicle with an antenna supported by a pane of glass of the vehicle.

Referring to FIG. 1, the antenna 10 is preferably integrated with a window 12 of a vehicle 14. This window 12 may be a rear window (backlite), a front window (windshield), or any other window of the vehicle 14. The antenna 10 may also be implemented in other situations completely separate from the vehicle 14, such as on a building or integrated with a radio receiver. The window 12 includes at least one nonconductive pane 18. The term "nonconductive" refers to a material, such as an insulator or dielectric, that when placed between conductors at different potentials, permits only a small or negligible current in phase with the applied voltage to flow through material. Typically, nonconductive materials have conductivities on the order of nanosiemens/meter.

In the preferred embodiment, the nonconductive pane 18 is implemented as at least one pane of glass 16. Of course, the window 12 may include more than one pane of glass 16. Those skilled in the art realize that automotive windows 12, particularly windshields, may include two panes of glass 16 sandwiching a layer of polyvinyl butyral (PVB).

The pane of glass 16 is preferably automotive glass and more preferably soda-lime-silica glass. The pane of glass 16 defines a thickness between 1.5 and 5.0 mm, preferably 3.1 mm. The pane of glass 16 also has a relative permittivity between 5 and 9, preferably 7. Those skilled in the art, however, realize that the nonconductive pane 18 may be formed from plastic, fiberglass, or other suitable nonconductive materials.

For descriptive purposes only, the subject invention is referred to below only in the context of the most preferred nonconductive pane 18, which is the pane of automotive glass 16. This is not to be construed as limiting, since, as noted above, the antenna 10 can be implemented with nonconductive panes 18 other than panes of glass 16.

Figure 2:
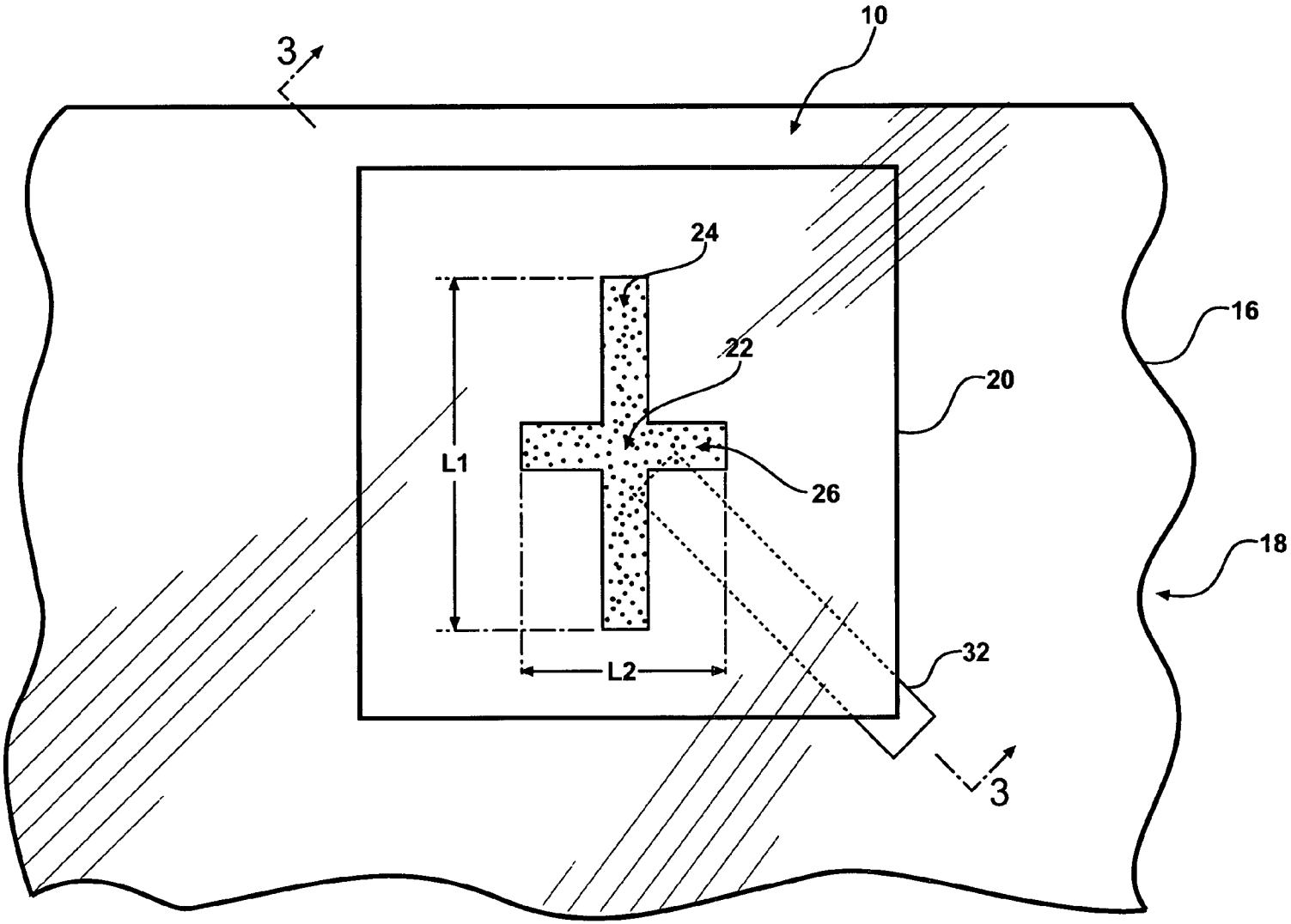
FIG. 2 is a top view of a preferred embodiment of the antenna showing a feed line and a radiation element with a rectangular shape defining a cross-shaped slot with legs that are parallel to the sides of the radiation element.
Figure 3:
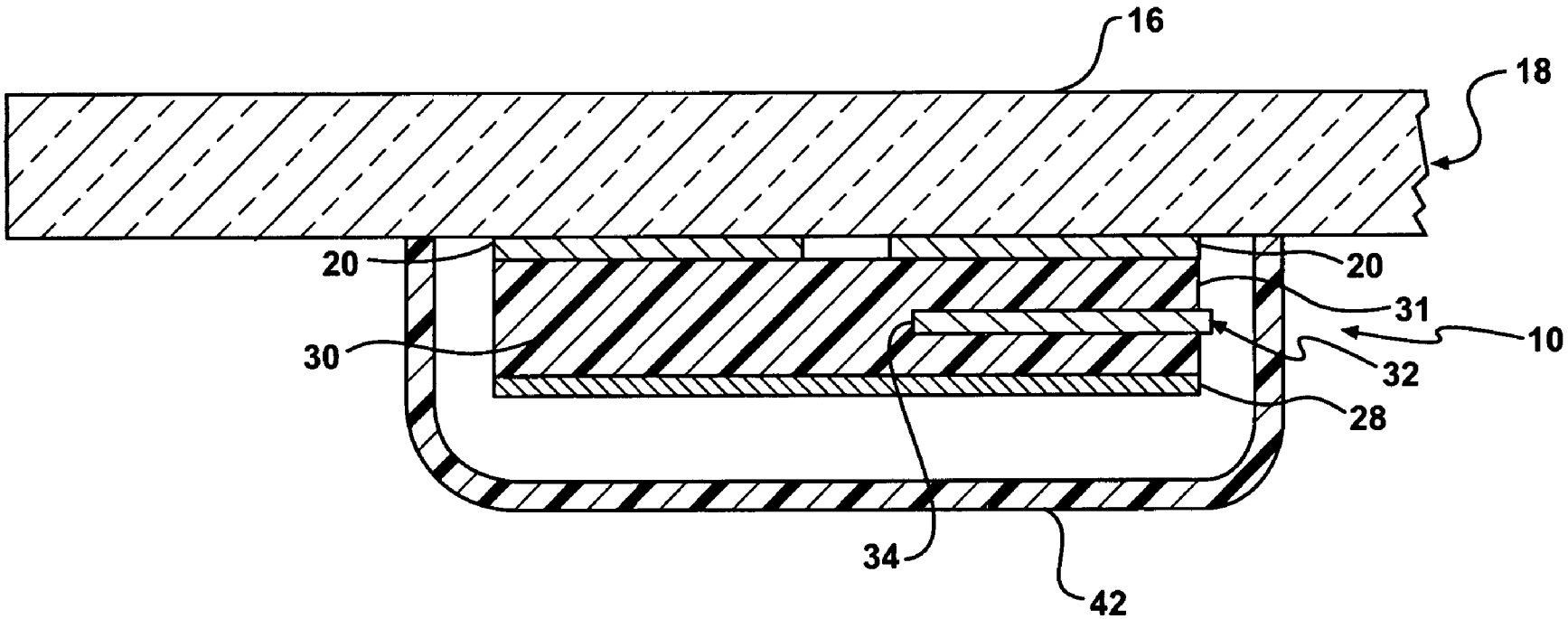
FIG. 3 is a cross-sectional side view of the preferred embodiment of the antenna taken along line 3—3 in FIG. 2 showing the pane of glass, the radiation element, a dielectric, the feed line, and a ground plane.

Referring now to FIGS. 2 and 3, the pane of glass 16 functions as a radome to the antenna 10. That is, the pane of glass 16 protects the other components of the antenna 10, as described in detail below, from moisture, wind, dust, etc. that are present outside the vehicle 14.

The antenna 10 of the preferred embodiment includes a radiation element 20 disposed on the pane of glass 16. The radiation element 20 is also commonly referred to by those skilled in the art as a "patch" or a "patch element". The radiation element 20 is formed of an electrically conductive material. Preferably, the radiation element 20 comprises a silver paste as the electrically conductive material disposed directly on the pane of glass 16 and hardened by a firing technique known to those skilled in the art. Alternatively, the radiation element 20 could comprise a flat piece of metal, such as copper or aluminum, adhered to the pane of glass 16 using an adhesive.

Figure 4:
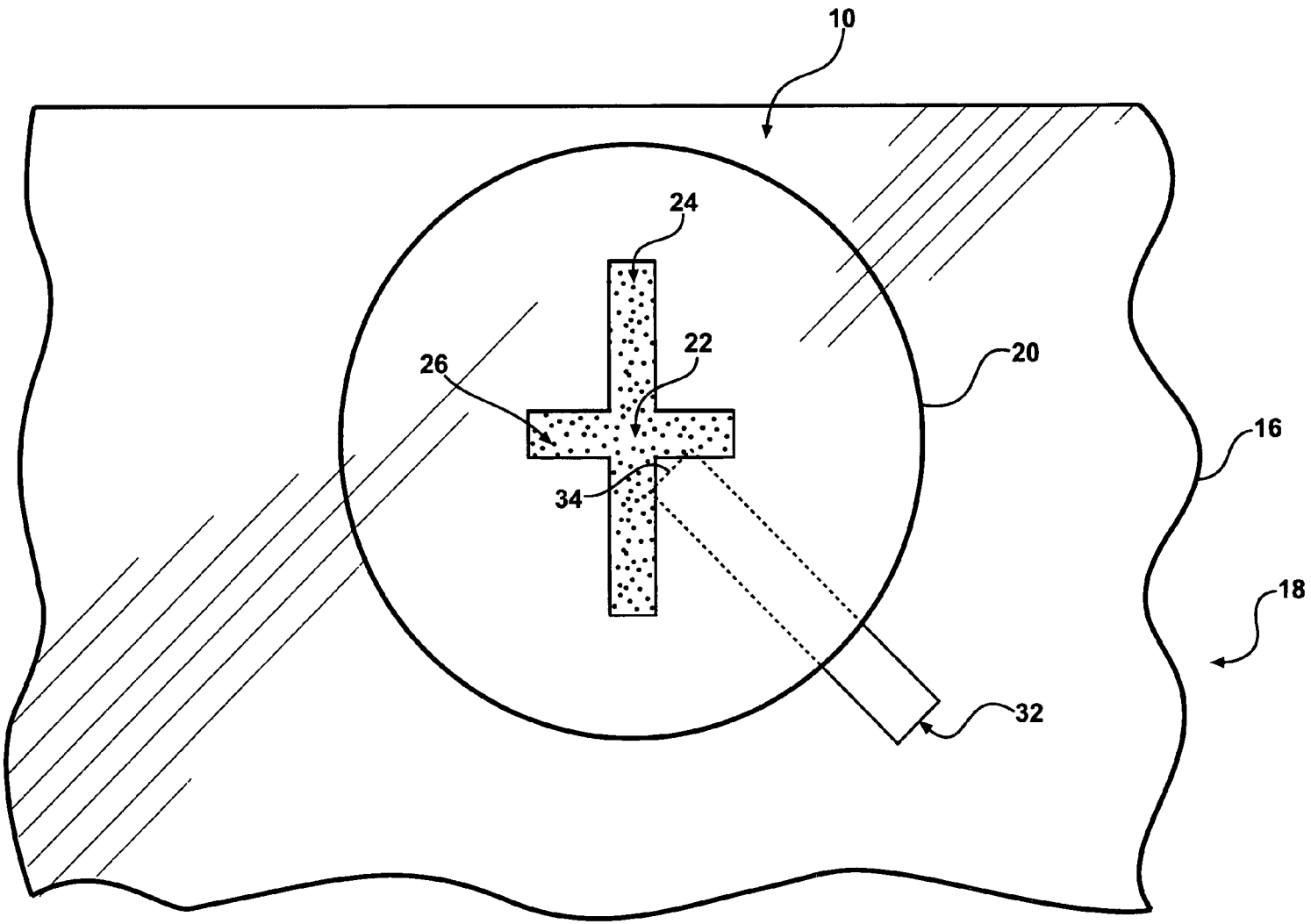
FIG. 4 is a top view of a first alternative embodiment of the antenna showing the radiation element with a circular shape defining a cross-shaped slot and the feed line.

When implemented on the window 12 of the vehicle 14, the size of the antenna 10 should be as small as possible to avoid causing visual obstruction to a driver of the vehicle 14. In the preferred embodiment, as shown in FIG. 2, the radiation element 20 is rectangularly-shaped, more preferably square-shaped. To address visual obstruction concerns, it is preferred that each side of the radiation element 20 is less than 42 mm. It is further preferred that each side of the radiation element 20 is in a range between 35 mm and 37 mm. Therefore, the radiation element 20 would occupy about a compact 1,300 $mm^2$ of the window 12. It should be understood that the Figures are not necessarily drawn to scale. In the preferred embodiment, the desired frequency is about 2,338 MHz, which corresponds to the center frequency used by XM® Satellite Radio. Therefore, each side of the radiation element 20 is sized to optimize performance at the 2,338 MHz frequency. In a first alternative embodiment, as shown in FIG. 4, the radiation element 20 is circularly-shaped and has a diameter less than 42 mm. Of course, those skilled in the art realize that various shapes and sizes of the radiation element 20 may be implemented to achieve similar performance results of the antenna 10.

Referring again to FIG. 2, the radiation element 20 defines a slot 22 having a first leg 24 and a second leg 26 generally perpendicular with each other. The slot 22 forms a periphery in the shape of a cross having a center point. The slot 22 is preferably centered within the radiation element 20.

In the preferred embodiment, the first leg 24 of the slot 22 has a first length $L_1$ and the second leg 26 of the slot 22 has a second length $L_2$. The first length $L_1$ is unequal to the second length $L_2$. These unequal lengths $L_1$, $L_2$ of the cross-shaped slot 22 provide the radiation element 20 with a circular polarization to receive the circularly polarized RF signal from the satellite. Those skilled in the art realize that each leg 24, 26 also provide the radiation element 20 with a linear polarization to receive a linearly polarized RF signal. The exact lengths $L_1$, $L_2$ of the legs 24, 26 of the slot 22 are determined by a desired frequency range, return loss, and axial ratio of the antenna 10. For optimization at the 2,338 MHz frequency of the preferred embodiment, the first length $L_1$ is in a range between 13.1 mm and 15.1 mm and the second length $L_2$ is in a range between 7.6 mm and 9.6 mm. Each leg 24, 26, also preferably has a width in a range between 1 mm and 3 mm. Of course, other ranges of dimensions of the legs 24, 26 are suitable to generate the circular polarization and for adequate operation of the antenna 10, depending on the desired operational frequency range, return loss, and axial ratio of the antenna 10. Furthermore, those skilled in the art realize that other techniques of generating circular polarization, besides the slot 22 in the shape of a cross having legs 24, 26 of unequal lengths, may be implemented. For instance, circular polarization may also be generated by the first leg 24 having a first width $W_1$, the second leg 26 having a second width $W_2$ unequal to the first width $W_1$, while the first and second lengths are substantially equal.

Figure 5:
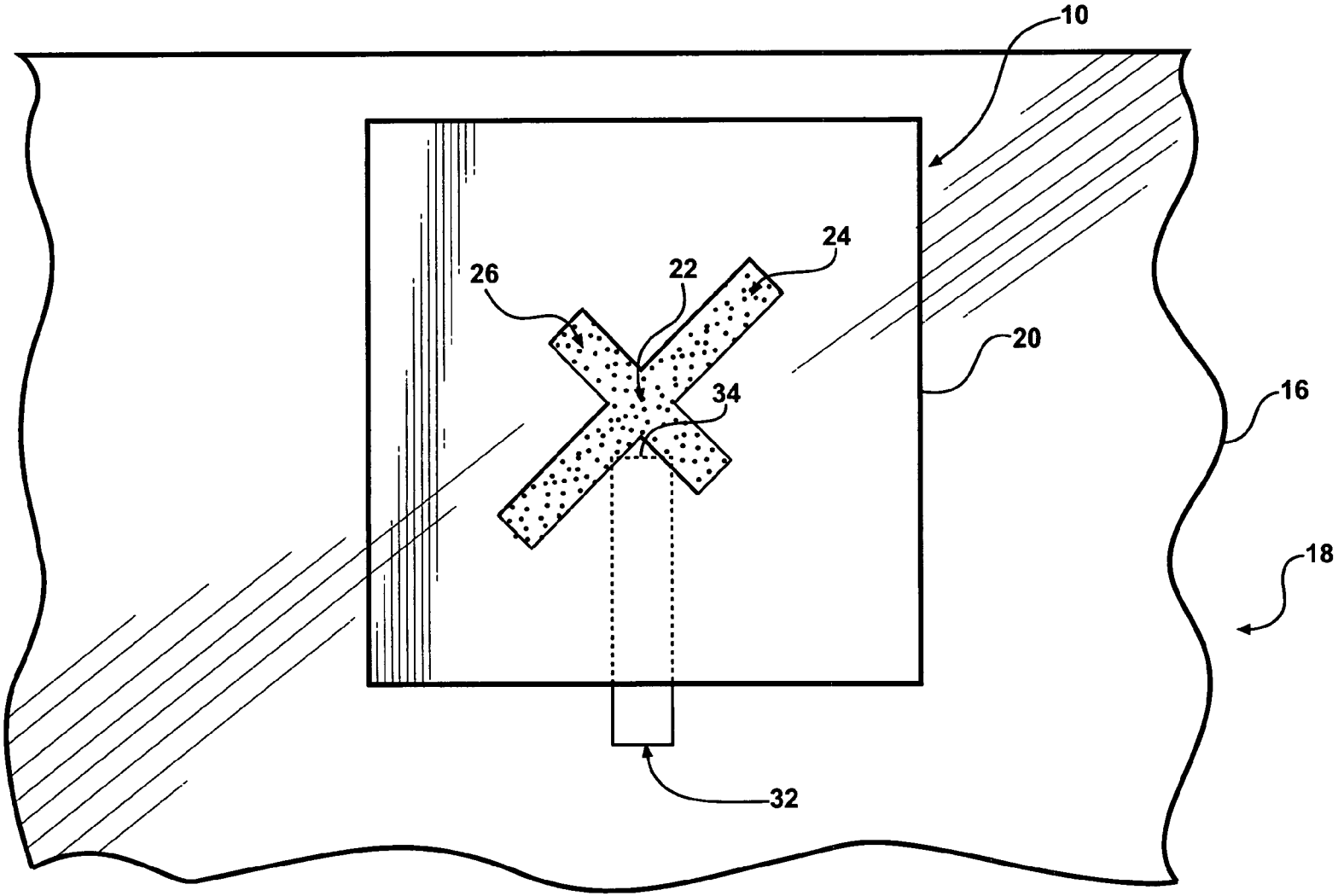
FIG. 5 is a top view of a second alternative embodiment of the antenna showing the radiation element with a rectangular shape defining the cross-shaped slot whose legs are at a 45° angle to the sides of the radiation element and the feed line.

In the preferred embodiment, where the radiation element 20 is rectangularly-shaped, each of the legs 24, 26 of the slot 22 is generally parallel to two sides of the radiation element 20. Of course other orientations of the legs 24, 26 to the sides of the radiation element 20 are possible. For example, a second alternative embodiment is shown in FIG. 5, where the legs 24, 26 are generally at a 45° angle to each side of the radiation element 20.

Referring again to FIG. 3, the antenna 10 further includes a ground plane 28. The ground plane 28 is disposed substantially parallel to and spaced from the radiation element 20. The ground plane 28 is formed of an electrically conductive material. In the preferred embodiment, the ground plane 28 is rectangularly-shaped. To match the dimensions of the radiation element 20, it is preferred that the each side of the ground plane 28 is about 36 mm. It is further preferred that the radiation element 20 and the ground plane 28 are centered with respect to one another. This similar sizing and orientation prevents additional visual obstruction to the driver of the vehicle 14. However, those skilled in the art realize that the ground plane 28 may have alternative sizes and shapes. Particularly, it is common practice for the ground plane 28 to have an area larger than that of the radiation element 20.

The antenna 10 also includes a dielectric substrate 30. The dielectric substrate 30 is sandwiched between the radiation element 20 and the ground plane 28. The dielectric substrate 30 presents an edge 31. The dielectric substrate 30 is formed of a nonconductive material and isolates the radiation element 20 from the ground plane 28. Therefore, the radiation element 20 and the ground plane 30 are not electrically connected by an electrically conductive material. Those skilled in the art realize that the dielectric substrate 30 could be air.

In the preferred embodiment, the dielectric substrate 30 is disposed in contact with the radiation element 20 and the ground plane 28. Of course, the dielectric substrate 30 may be sandwiched between the radiation element 20 and the ground plane 28 without being in direct contact with the radiation element 20 and/or the ground plane 28. Furthermore, the dielectric substrate 30 may extend beyond the areas defined by the radiation element 20 and the ground plane 28 so long as at least a portion of the dielectric substrate 30 is between the radiation element 20 and the ground plane 28.

It is preferred that the dielectric substrate 30 have a dielectric substrate thickness measuring about 3.2 mm. It is further preferred that the dielectric substrate 30 has a relative permittivity of about 2.6. However, those skilled in the art realize the dielectric substrate 30 may have other dimensions and/or relative permittivity. Further, the dielectric substrate 30 may be composed of a plurality of layers or regions. The relative permittivity of each of these layers or regions may be identical to each other or may be different from each other.

The antenna 10 also includes an electrically conductive feed line 32. The feed line 32 is a transmission device that is preferably electromagnetically coupled to the radiation element 20 and the ground plane 30. The term "electromagnetically coupled", as used in the art, refers to the feed line 32 not being in direct contact with the radiation element 20. In the case of the present invention, the feed line 32 runs generally parallel to the radiation element 20 and the ground plane 30. However, those skilled in the art realize that the feed line 32 may be directly connected to the radiation element 20, i.e., the feed line 32 may come into direct contact with the radiation element 20.

The feed line 32 includes a distal end 34 extending within the dielectric substrate 30 from the edge 31 of the dielectric substrate 30. The feed line 32 terminates at the distal end 34 short of the center point of the slot 22. Preferably, the distal end 34 terminates less than 12 mm from the center point of the slot 22. More preferably, the feed line 32 terminates about 2 mm from the center point of the slot 22. In the preferred embodiment, the feed line 32 is rectangularly-shaped with a width of about 4.5 mm. It is also preferred that the feed line 32 is disposed at about a 45° angle relative to the legs of the slot 22 for properly generating the circular polarization of the antenna 10. Those skilled in the art realize that alternative dimensions of the feed line 32 may be implemented depending on the desired use of the antenna 10. Furthermore, the dimensions of the feed line 32 may be modified for tuning purposes, i.e., to match the input impedance of the antenna 10 to a transmission line connected to the antenna 10.

Figure 6:
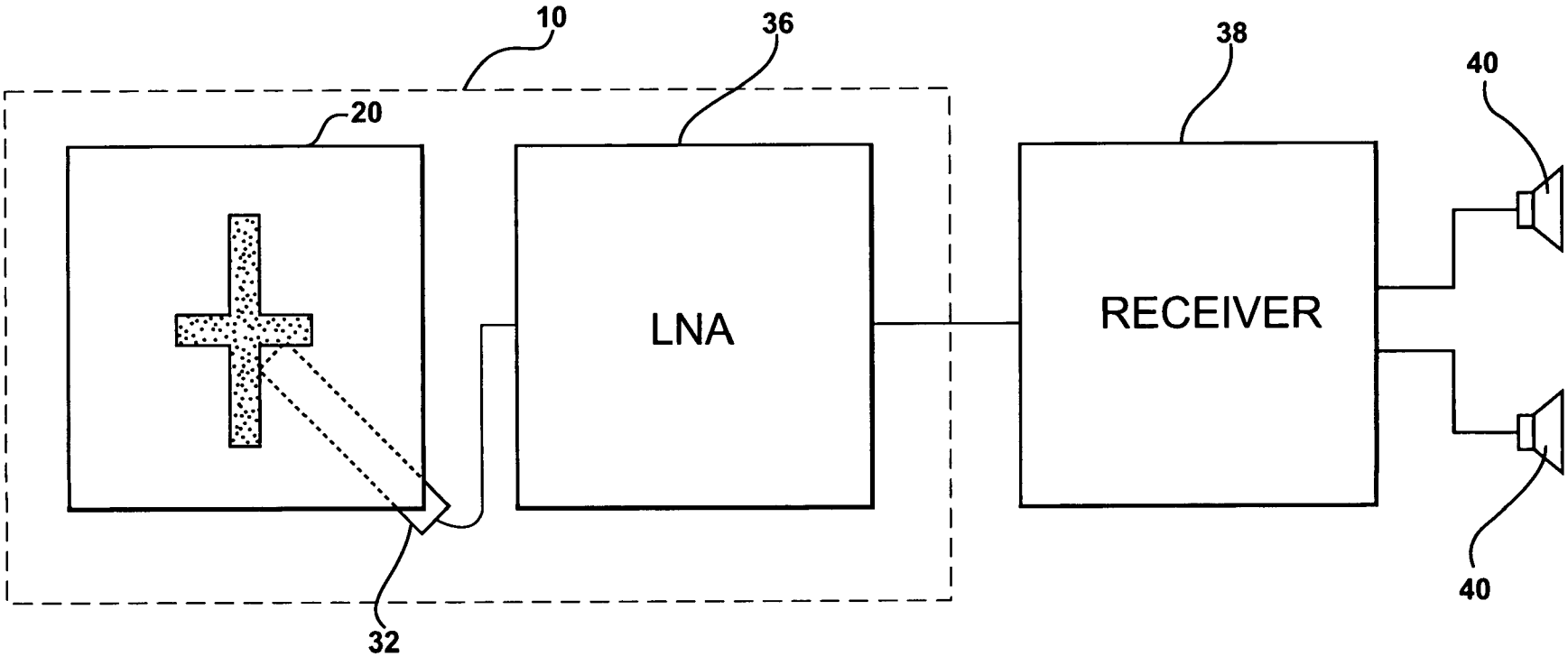
FIG. 6 is a block diagram showing the antenna with the feed line connected to an amplifier and the amplifier connected to a receiver.

Referring to FIG. 6, the antenna 10 may also include an amplifier 36 electrically connected to the feed line 32 for amplifying a signal received by the antenna 10. The amplifier 36 amplifies the RF signal received by the antenna 10 and provides an amplified signal. The amplifier 36 is preferably a low-noise amplifier (LNA) 36 such as those well known to those skilled in the art. The LNA 36 is typically connected to a receiver 38 which receives the amplified signal. The receiver 38 then processes the amplified signal and provides an audio signal to speakers 40.

Figure 7:
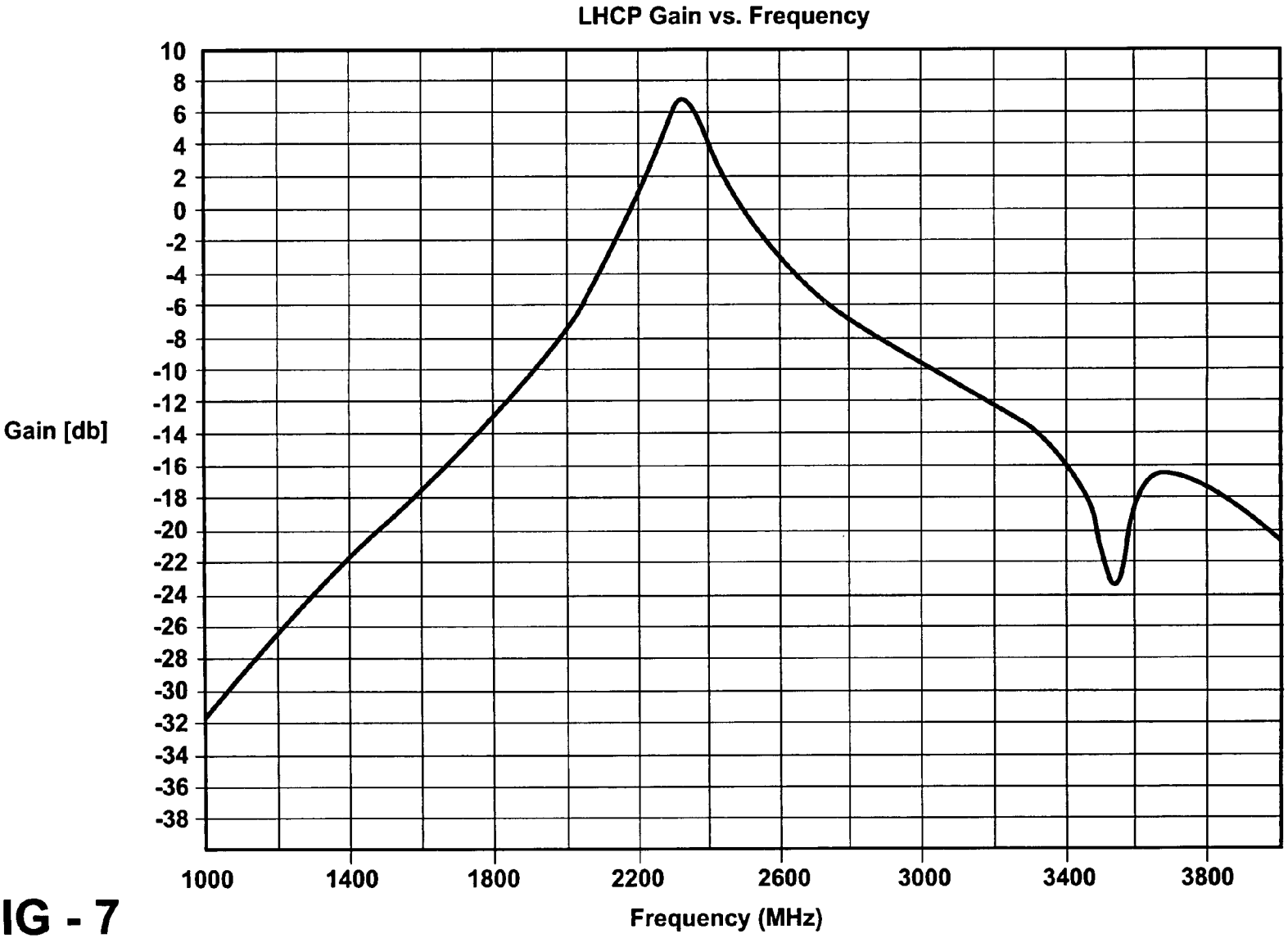
FIG. 7 is a chart showing gain of a left-hand circular polarized signal versus frequency for the preferred embodiment of the antenna.
Figure 8:
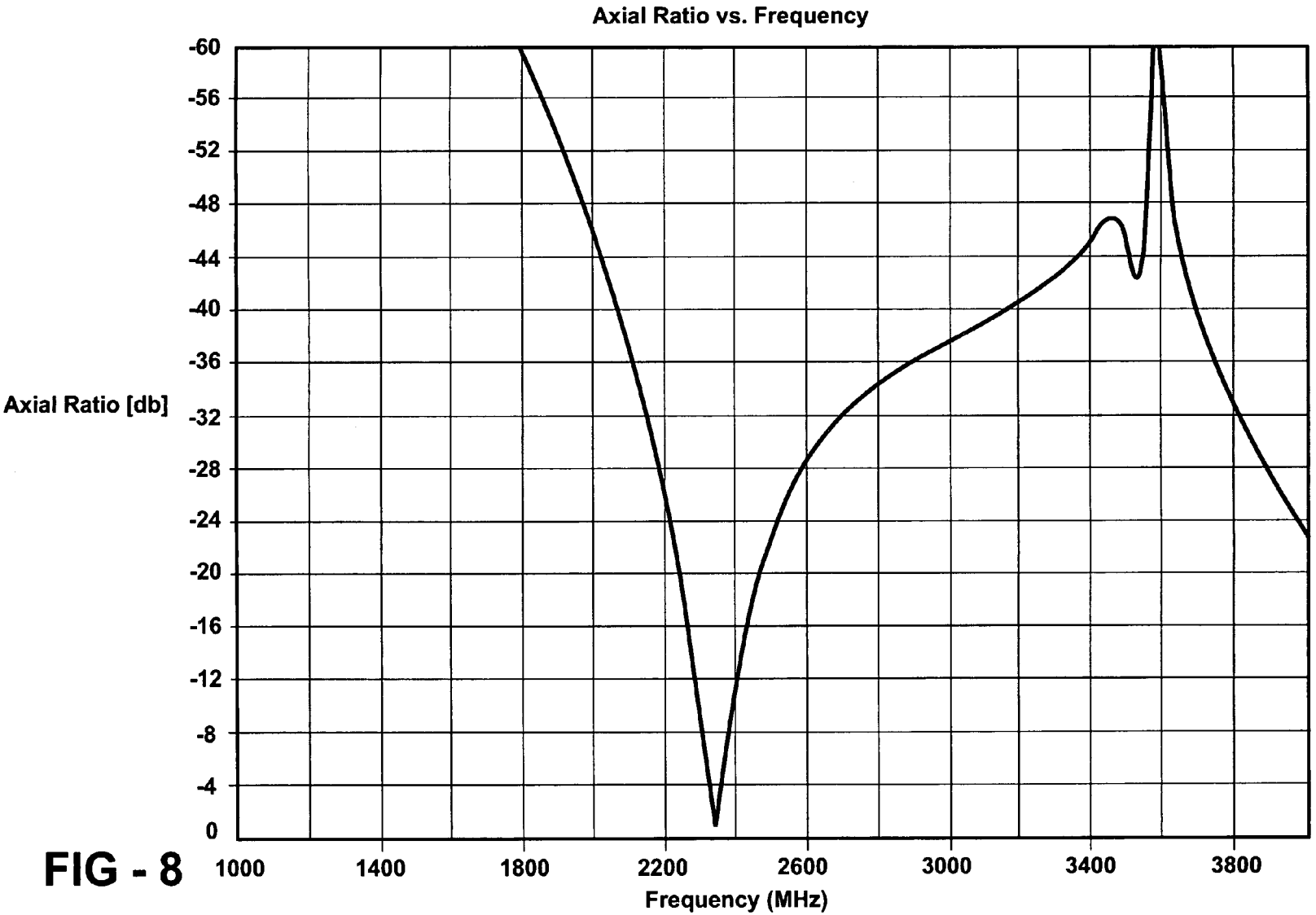
FIG. 8 is a chart showing axial ratio versus frequency for the preferred embodiment of the antenna.
Figure 9:
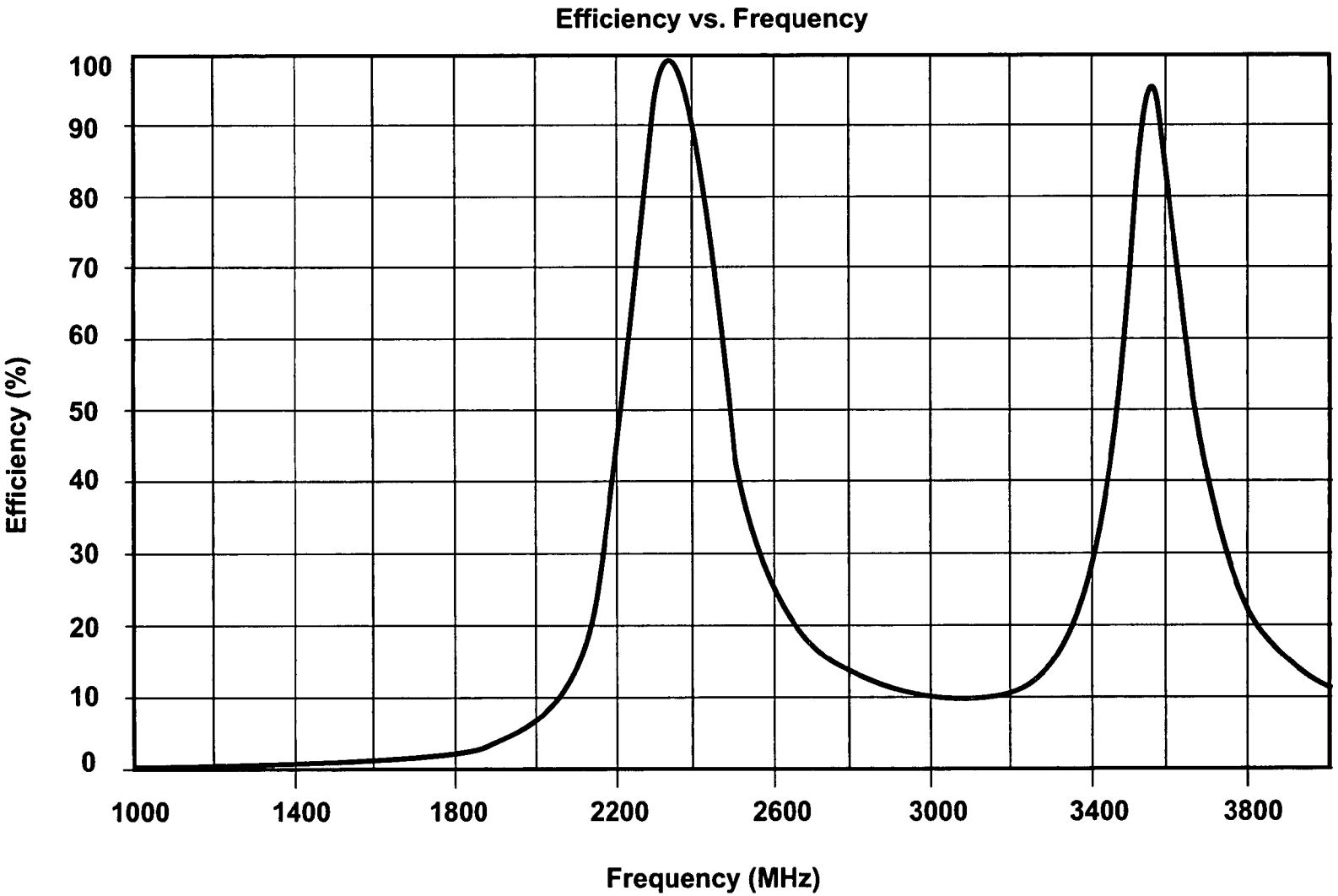
FIG. 9 is a chart showing radiation efficiency versus frequency for the preferred embodiment of the antenna.

In the preferred embodiment, as described above, the feed line 32 does not extend past the center point of the slot 22. This provides a significant contribution to the exceptional radiation gain and other performance characteristics of the antenna 10. Referring to FIG. 7, the antenna 10, as implemented in the preferred embodiment provides a 6.7 dBic LHCP gain at the desired frequency of 2,338 MHz. The antenna 10 of the preferred embodiment also provides, at 2,338 MHz, an axial ratio of 0.8 dB, as shown in FIG. 8. The antenna 10 provides a return loss of 25.4 dB at 2,338 MHz. This excellent return loss provides the antenna 10 with an efficiency of 99%, as shown in FIG. 9. Those skilled in the art realized that the efficiency of the antenna 10 relates to the proportion of the RF signal that is received by the antenna that is actually passed to the amplifier 36. The efficiency curve shown also reveals that the antenna 10, as implemented in the preferred embodiment, performs well a second frequency band centered at about 3,550 MHz. As shown by the performance characteristics cited above, not only does the antenna 10 exhibit excellent circular polarization at 2,338 MHz, but also provides linear polarization at this frequency as well. Thus, the antenna 10 exhibits properties of a dual-band antenna.

A cover 42, as shown in FIG. 3, may also be affixed to the pane of glass 16 to enclose the ground plane 28, the radiation element 20, and the dielectric substrate 30. The cover 42 protects the antenna 10 from dust, dirt, contaminants, accidental breakage, etc., as well as providing the antenna 10 with a more aesthetic appearance.

The pane of glass 16 of the preferred embodiment, as mentioned above, preferably has a relative permittivity of 7. Therefore, the pane of glass 16 affects the performance characteristics of the antenna 10. It is understood by those skilled in the art that the antenna 10 may be modified (or tuned) for similar performance in alternative embodiments where the nonconductive pane 18 is a material other than the pane of glass 16.

Multiple antennas 10 may be implemented as part of a diversity system of antennas 10. For instance, the vehicle 14 of the preferred embodiment may include a first antenna 10 on the windshield and a second antenna 10 on the backlite. These antennas 10 would each have separate LNAs 36 that are electrically connected to the receiver within the vehicle 14. Those skilled in the art realize several processing techniques may be used to achieve diversity reception. In one such technique, a switch is used to select the antenna 10 that is currently receiving the strongest RF signal from the satellites.

Obviously, many modifications and variations of the present invention are possible in light of the above teachings. The invention may be practiced otherwise than as specifically described within the scope of the appended claims.

What is claimed is:

1. A window having an integrated antenna, said window comprising:

a nonconductive pane;

a radiation element disposed on said nonconductive pane;

said radiation element defining a slot having a center point and a first leg and a second leg generally perpendicular with each other to form a periphery in the shape of a cross;

a ground plane disposed substantially parallel to and spaced from said radiation element;

a dielectric substrate sandwiched between said radiation element and said ground plane and presenting an edge, said dielectric substrate isolating said radiation element from said ground plane;

an electrically conductive feed line disposed within said dielectric substrate and having a distal end; wherein said feed line extends within said dielectric from said edge of said dielectric and terminates at said distal end short of said center point of said slot.

2. A window as set forth in claim 1 wherein said nonconductive pane is further defined as a pane of glass.

3. A window as set forth in claim 2 wherein said pane of glass is further defined as automotive glass.

4. A window as set forth in claim 3 wherein said automotive glass is further defined as soda-lime-silica glass.

5. A window as set forth in claim 1 wherein said distal end terminates less than 12 mm from said center point of said slot.

6. A window as set forth in claim 5 wherein said distal end terminates about 2 mm from said center point of said slot.

7. A window as set forth in claim 1 wherein said feed line is rectangularly-shaped.

8. A window as set forth in claim 7 wherein said feed line is disposed at about a 45° angle relative to said legs of said slot.

9. A window as set forth in claim 1 wherein said radiation element is rectangularly-shaped.

10. A window as set forth in claim 9 wherein each side of said radiation element is less than 42 mm.

11. A window as set forth in claim 10 wherein each side of said radiation element is about 36 mm.

12. A window as set forth in claim 11 wherein each side of said radiation element measures about 36 mm and each side of said ground plane measures about 36 mm.

13. A window as set forth in claim 12 wherein said radiation element and said ground plane are centered with respect to one another.

14. A window as set forth in claim 9 wherein said ground plane is rectangularly-shaped.

15. A window as set forth in claim 9 wherein each of said legs of said slot are generally parallel to two sides of said radiation element.

16. A window as set forth in claim 1 wherein said radiation element is circularly-shaped.

17. A window as set forth in claim 16 wherein a diameter of said radiation element is less than 42 mm.

18. A window as set forth in claim 1 wherein said first leg of said slot has a first length and said second leg of said slot has a second length unequal to said first length for generating a circular polarization.

19. A window as set forth in claim 1 wherein said first leg of said slot has a first width and said second leg of said slot has a second width unequal to said first width for generating a circular polarization.

20. A window as set forth in claim 1 wherein said dielectric substrate is disposed in contact with said radiation element and said ground plane.

21. A window as set forth in claim 1 wherein said dielectric substrate has a dielectric substrate thickness measuring about 3.2 mm.

22. A window as set forth in claim 1 wherein said dielectric substrate has a relative permittivity of 2.6.

23. A window as set forth in claim 1 wherein said slot is centered within said radiation element.

24. A window as set forth in claim 1 further comprising an amplifier electrically connected to said feed line for amplifying a signal received by said antenna.

25. A window as set forth in claim 1 further comprising a cover affixed to said nonconductive pane for enclosing said ground plane, said radiation element, and said dielectric substrate.

26. An antenna comprising:

a radiation element;

said radiation element defining a slot having a first leg and a second leg generally perpendicular with each other to form a periphery in the shape of a cross having a center point;

a ground plane disposed substantially parallel to and spaced from said radiation element;

a dielectric substrate sandwiched between said radiation element and said ground plane and presenting an edge; and an electrically conductive feed line having a distal end and extending within said dielectric substrate from said edge of said dielectric substrate and terminating at said distal end short of said center point of said slot.

27. An antenna as set forth in claim 26 wherein said distal end terminates less than 12 mm from said center point of said slot.

28. An antenna as set forth in claim 27 wherein said distal end terminates about 2 mm from said center point of said slot.

29. An antenna as set forth in claim 26 wherein said feed line is rectangularly-shaped.

30. An antenna as set forth in claim 29 wherein said feed line is disposed at about a 45° angle relative to said legs of said slot.

31. An antenna as set forth in claim 26 wherein said radiation element is rectangularly-shaped.

32. An antenna as set forth in claim 31 wherein each side of said radiation element is less than 42 mm.

33. An antenna as set forth in claim 32 wherein each side of said radiation element is about 36 mm.

34. An antenna as set forth in claim 31 wherein said ground plane is rectangularly-shaped.

35. An antenna as set forth in claim 34 wherein each side of said radiation element measures about 36 mm and each side of said ground plane measures about 36 mm.

36. An antenna as set forth in claim 35 wherein said radiation element and said ground plane are centered with respect to one another.

37. An antenna as set forth in claim 31 wherein each of said legs of said slot are generally parallel to two sides of said radiation element.

38. An antenna as set forth in claim 26 wherein said radiation element is circularly-shaped.

39. An antenna as set forth in claim 38 wherein a diameter of said radiation element is less than 42 mm.

40. An antenna as set forth in claim 26 wherein said first leg of said slot extends to a first length and said second leg of said slot extends to a second length unequal to said first length for generating a circular polarization.

41. An antenna as set forth in claim 26 wherein said first leg of said slot has a first width and said second leg of said slot has a second width unequal to said first width for generating a circular polarization.

42. An antenna as set forth in claim 26 wherein said dielectric substrate is disposed in contact with said radiation element and said ground plane.

43. An antenna as set forth in claim 26 wherein said dielectric substrate has a dielectric substrate thickness measuring about 3.2 mm.

44. An antenna as set forth in claim 26 wherein said dielectric substrate has a relative permittivity of 2.6.

45. An antenna as set forth in claim 26 wherein said slot is centered within said radiation element.

46. An antenna as set forth in claim 26 further comprising an amplifier electrically connected to said feed line for amplifying a signal received by said antenna.

47. An antenna as set forth in claim 26 in combination with a nonconductive pane wherein said radiation element is disposed on said nonconductive pane.

48. An antenna as set forth in claim 47 wherein said nonconductive pane is further defined as a pane of glass.

49. An antenna as set forth in claim 48 wherein said pane of glass is further defined as automotive glass.

50. An antenna as set forth in claim 49 wherein said automotive glass is further defined as soda-lime-silica glass.

51. An antenna as set forth in claim 50 further comprising a cover affixed to said nonconductive pane for enclosing said ground plane, said radiation element, and said dielectric substrate.

52. A window having an integrated antenna, said window comprising:

a nonconductive pane;

a radiation element disposed on said nonconductive pane;

said radiation element defining a slot having a first leg and a second leg generally perpendicular with each other to form a periphery in the shape of a cross having a center point;

a ground plane disposed substantially parallel to and spaced from said radiation element;

a dielectric substrate sandwiched between said radiation element and said ground plane and presenting an edge; and an electrically conductive feed line having a distal end and extending within said dielectric substrate from said edge of said dielectric substrate and terminating at said distal end short of said center point of said slot.

* * * * *